United States Patent [19]

Makishima et al.

[11] Patent Number: 4,930,527

[45] Date of Patent: Jun. 5, 1990

[54] HAIR ORNAMENT AND METHOD OF MAKING THE SAME

[76] Inventors: Kozoh Makishima; Kyoko Makishima, both of No. 3-35, Ohizumi Gakuen-cho 6-chome, Nerima-ku, Tokyo, Japan

[21] Appl. No.: 161,063

[22] Filed: Feb. 26, 1988

[30] Foreign Application Priority Data

Mar. 2, 1987 [JP] Japan ..... 62-45210

[51] Int. Cl.[5] ..... A41G 3/00

[52] U.S. Cl. ..... 132/201; 132/203; 132/56

[58] Field of Search ..... 132/53, 54, 55, 56, 132/201, 203, 210

[56] References Cited

U.S. PATENT DOCUMENTS

| | | | |
|---|---|---|---|
| 3,342,189 | 9/1967 | Houston | 132/53 |
| 3,520,310 | 7/1970 | Witmondt | 132/53 |
| 4,115,549 | 9/1978 | Scott | 132/203 |

FOREIGN PATENT DOCUMENTS 18655 6/1975 Japan .

OTHER PUBLICATIONS

Utility Model Registration Application No. 107470, Filed Oct. 29, 1970.

*Primary Examiner*—John Weiss

*Attorney, Agent, or Firm*—Armstrong, Nikaido, Marmelstein, Kubovcik & Murray

[57] ABSTRACT

A hair ornament and method of manufacturing such hair ornament comprising a plurality of spaced fiber strands each composed of a number of gradually curled synthetic fibers laid parallel to each other. Each of the fiber strands has a formed portion in which fibers extending toward one end thereof are spread horizontally and bent while being partly overlapped. The formed portions of the fiber strands are partly superposed on adjacent ones and arranged into a bowl-shaped configuration as a whole, the fibers including adjacent fibers fixed to each other by an adhesive applied over the entire area of the hair ornament and fixing the fibers in the formed shape.

8 Claims, 14 Drawing Sheets

HAIR ORNAMENT AND METHOD OF MAKING THE SAME

BACKGROUND OF THE INVENTION

The present invention relates to a hair ornament made of synthetic fibers, which may be used in various ways, e.g., as a hat or a wig, and a method of making the hair ornament.

Known hair ornaments include those which are worn on hair like a hat, those which are attached to the hair like a ribbon, a hairpiece, or an ornamental hairpin, and those which are worn to conceal hair or a bald spot like a wig.

Hats have long been used as hair ornaments. The hats cannot always be worn by users because their use may be inhibited under certain conditions.

Hair ornaments such as ribbons which are attached to hair can be use relatively regardless of different conditions. The hair ornaments of this type are however only effective to give an ornamental effect to a part of the hair. Persons with fewer hairs have difficulty in wearing these hair ornaments.

Wigs also include ornamental wigs used in plays. Since a wig comprises synthetic fibers implanted on or bonded to a wig base, the wig is relatively heavy and less permeable to air. Therefore, the wearer of the wig may be uncomfortable.

In view of the hair ornaments which have heretofore been available in the market, there has been a demand for a hair ornament which can be used at any time, worn by anybody irrespective of the hair condition, has an excellent ornamental effect for the hair, is lightweight, and highly permeable to air.

SUMMARY OF THE INVENTION

It is an object of the present invention to provide a hair ornament which is of a good formative appearance that does not give an odd look to other people when it is worn as a hat or a hairpiece or wig, which is lightweight and highly permeable to air, and which allows the user to feel comfortable when worn.

Another object of the present invention is to provide a method of manufacturing a hair ornament with ease.

To achieve the first object, there is provided a first hair ornament comprising a plurality of spaced fiber strands each composed of a number of gradually curled synthetic fibers laid parallel to each other, each of the fiber strands having a formed portion in which fibers extending toward one end thereof are spread horizontally and bent while being partly overlapped, the formed portions of the fiber strands being partly superposed on adjacent fibers and arranged into a bowl-shaped configuration as a whole, the fibers including adjacent fibers fixed to each other by an adhesive sprayed over the entire area of the hair ornament.

In the first hair ornament, the formed portions of the fiber strands serve to give a variety of formative appearances as a whole, and the fibers and the formed portions are firmly joined to each other by the adhesive to keep a suitable shape that can be put on the head of a user.

Since only the fiber strands are bonded by the adhesive, the hair ornament is lightweight and permeable to air.

According to the present invention, there is also provided a second hair ornament comprising a plurality of spaced fiber strands each composed of a number of gradually curled synthetic fibers laid parallel to each other, at least one of the fiber strands having a formed portion in which fibers extending toward one end thereof are spread horizontally and bent while being partly overlapped, and an overlapped portion in which end fibers of the formed portion are folded back in overlapping relation to adjacent fibers, the other fiber strands having respective formed portions in which fibers extending toward one end thereof are spread horizontally and bent while being partly overlapped, the formed portions of the fiber strands being partly superposed on adjacent ones and arranged into a bowl-shaped configuration as a whole, the fibers including adjacent fibers fixed to each other by an adhesive sprayed over the entire area of the hair ornament.

In the second hair ornament, the formed portions of the fiber strands serve to give a variety of formative appearances as a whole, and the end fibers of the formed portion of at least one of the fiber strands are folded back and bonded to adjacent fibers in overlapping relation.

According to the present invention, there is also provided a method of manufacturing a hair ornament, comprising the steps of: detachably fixing, in spaced relation, a plurality of fiber strands each composed of a number of gradually curled synthetic fibers laid parallel to each other, to a fixed base having a semispherical outer shape and a parting layer; horizontally spreading and bending fibers of the fixed fiber strands extending from fixed positions toward one end of the fibers while holding the fibers in partly overlapped relation, thereby forming a plurality of formed portions; arranging the formed portions, while superposing the formed portions on adjacent ones, along the semispherical outer shape of the fixed base into a bowl-shaped configuration and temporarily fastening the formed portions to the fixed base; spraying an adhesive over the formed portions; drying the sprayed adhesive; and removing the fiber bundle with the dried and solidified adhesive from the fixed base.

The above method is capable of manufacturing the first hair ornament as described above.

According to the present invention, there is further provided a method of manufacturing a hair ornament, comprising the steps of: detachably mounting, on a fixed base, a model having a flange disposed on an outer edge of a semispherical member and bent inwardly, the model also including a parting layer; detachably fixing, in spaced relation, a plurality of fiber strands each composed of a number of gradually curled synthetic fibers laid parallel to each other, to an outer surface of the model; horizontally spreading and bending fibers of at least one of the fiber strands extending toward one end of the fibers while holding the fibers in partly overlapped relation, thereby forming a formed portion, and causing end fibers to extend outwardly from the outer edge of the model; tying the end fibers extending outwardly from the outer edge of the model along the flange of the model with a string; folding back the end fibers over the outer surface of the model from a tied position and superposing folded ends of the fibers on adjacent fibers, thus forming an overlapped portion; temporarily fastening the folded fibers to the model in the overlapped portion; horizontally spreading and bending fibers of the other fiber strands extending from fixed positions toward one end of the fibers while holding the fibers in partly overlapped relation, thereby forming a plurality of formed portions; arranging the formed portions, while superposing the formed portions on adjacent ones, along a semispherical outer shape of the fixed base into a bowl-shaped configuration and temporarily fastening the formed portions to be the fixed base; spraying an adhesive over the formed portions and the overlapped portion; drying the sprayed adhesive; removing the string from the overlapped portion; and removing the fibers with the dried and solidified adhesive from the fixed base.

The above further method is capable of manufacturing the second hair ornament as described above.

The above and other objects, features and advantages of the present invention will become more apparent from the following description when taken in conjunction with the accompanying drawings in which preferred embodiments of the present invention are shown by way of illustrative example.

DETAILED DESCRIPTION

Figure 1:
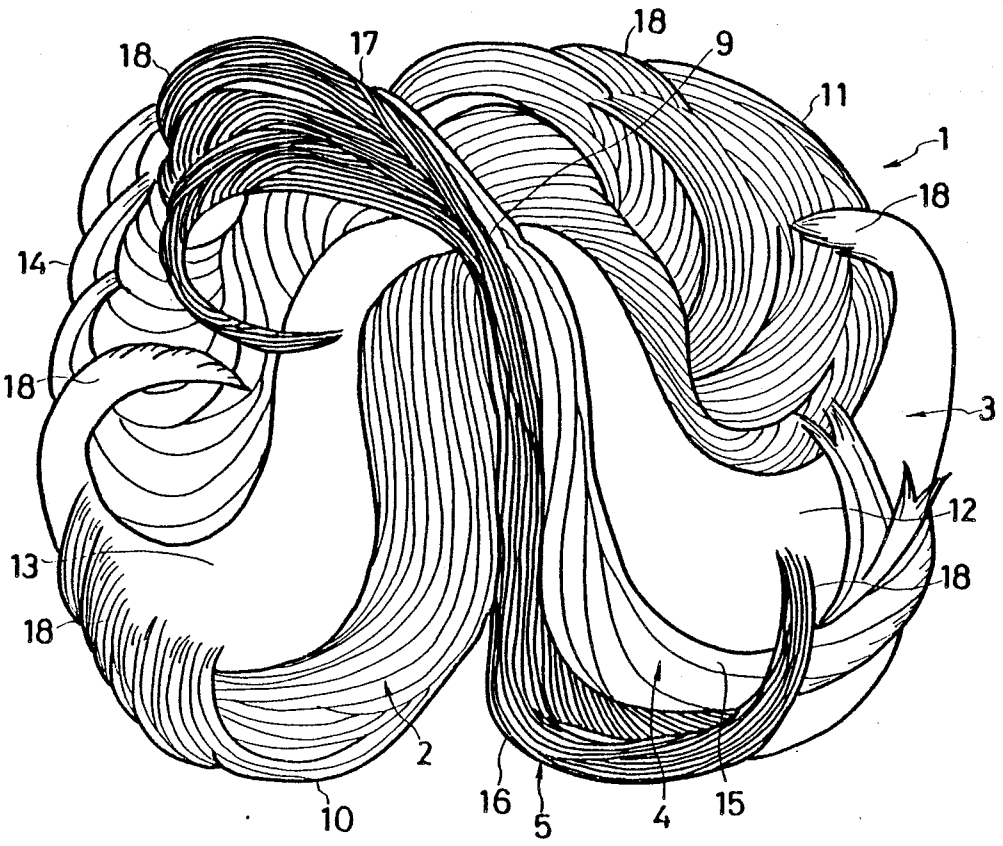
FIG. 1 is a perspective view of a hair ornament according to an embodiment of the present invention.

Synthetic fibers making up a hair ornament according to the present invention are of a thickness ranging from several tens of denier to several tens of thousands of denier. Those synthetic fibers of 30 to 100 denier, which are used as dummy hairs of a wig, are preferable as they are lightweight and can easily be formed to shape. The fibers are made of a material selected from the group consisting of polyvinyl chloride, vinyl chloride - vinyl acetate copolymer, polyamide, polyvinylidene chloride, and polypropylene.

Basic elements of the hair ornament are fiber strands each composed of several thousands to ten thousands of fibers laid parallel to each other. To meet user's tastes, the fiber strands are composed of fibers of different colors, or each fiber strand comprise fibers of plural colors.

The fiber strands are wound around a rod-shaped core and heated so as to be gradually spirally coiled as a whole, so that the fibers are curved or curled. The curled synthetic fibers are effective in bending and shaping themselves to desired forms, and also in keeping the configuration of formed portions when overlapping fibers are bonded by an adhesive.

The fibers of the fiber strand are horizontally spread while being partly overlapped to give a horizontal spread, and also are bent to give a three-dimensional spread, thus providing formed portions. To shape the formed portion to desired configuration, the fiber strand has a gathered portion in which the fibers are gathered closely, and fibers extending from the gathered portion toward one end thereof are spread horizontally and bent while being partly overlapped. Where the gathered portion is located in an intermediate position of the fiber strand, two formed portions are disposed on one each side of the gathered portion, thereby producing a varied formative effect.

More specifically, in each of the formed portions, the fibers are partly or wholly laid parallel and spread by a comb or the like, and shaped into various forms according to the curl given to the fibers. If necessary, the fibers are additionally coiled around a mesh curler or curved by a brush, and then heated by a drier so as to be given a wavy shape. Then, the fibers are fixed by a hairpin or a hair clip, and unwanted fiber portions are trimmed off. When shaping the fibers utilizing the curls given thereto, the fiber strands may be curled to difference degrees, so that the formed portions will have different looks.

The fiber strands having such formed portions are put together while the formed portions are partly overlapped, to create a formative appearance giving rise to a horizontal spread as a whole. The formed portions thus put together are arranged in a bowl-shaped configuration which is complementary in shape to the head of the user, and are bonded by an adhesive into a unitary structure.

To fix the formed portions, the adhesive is sprayed or otherwise applied over the entire formed portions to bond the formed portions and the fibers thereof in overlapping areas thereof. Since the fibers are gradually curled in advance, the fibers are joined at overlapping portions and tend to be spaced apart due to the resiliency of the curved fibers. Accordingly, the fibers remain suitably spaced from each other without being lumped together, so that the attained form will be maintained.

It is preferable from the standpoint of providing a good appearance that the adhesive be diluted by a solvent and the solution be sprayed as a mist over the fibers so as not to be attached as adhesive droplets of the fibers. If the adhesive was applied under a highly humid condition, the adhesive might be whitened due to moisture when dried. To prevent such a poor appearance, the adhesive should be dried to a suitably dry condition.

The adhesive used may be any adhesive for use with the synthetic fibers of the materials specified above. Preferably, thermoplastic resin adhesives, particularly, vinyl and acrylic adhesives such as of vinyl acetate and copolymer of vinyl acetate and acrylic ester are preferable.

More preferably, according to the present invention, an acrylic paint or the like may be sprayed as a forming agent over the entire hair ornament which has been given a unitary shape by the adhesive in order to improve the retentivity of the shape of the formed portions for keeping the hair ornament configuration for a long period of time.

When manufacturing a hair ornament according to the present invention, a plurality of fiber strands of the nature described above are placed in spaced relation on a fixed base having at least a semispherical outer surface and a parting layer on the surface, and the fiber strands are partly fixed detachably to the fixed base by means of pins. The parting layer is effective in removing the fiber strands from the fixed base after an adhesive has been applied. The parting layer may comprise a coated parting agent or a film-like parting layer covering. Thereafter, the fibers of one fiber strand are spread horizontally and bent from the fixed position toward one end of the fibers while holding the fibers in partly overlapping relation, thereby providing a three-dimensional formed portion having a horizontal spread. While keeping the shape of the formed portions, the fibers are temporarily fastened to the surface of the fixed base by pins at plural locations. The similarly prepared formed portions of the other fiber strands are then placed on the fixed base in close and partly overlapping relation to each other so as to cover the entire semispherical surface of the fixed base in the shape of a bowl, whereupon the formed portions are temporarily fastened to the surface of the fixed base by pins. Then, an adhesive is sprayed and applied over the inner and outer surfaces of the hair ornament. If necessary, the adhesive may be applied while the formed portions are prepared in order to fix the formed fibers. Thereafter, the hair ornament is dried by being heated or natural drying to bond the formed portions to each other and to bond the fibers of the formed portions. A forming agent may also be sprayed and applied over the inner and outer surfaces to give shape retentivity, and then dried. Subsequently, the hair ornament is removed from the fixed base. The hair ornament thus produced is of a good formative appearance.

Each of the formed portions includes an overlapping portion in which the end fibers are folded back in overlapping relation to adjacent fibers and bonded to these adjacent fibers by an adhesive. With this arrangement, the peripheral edge of the hair ornament, when worn by a user, does not irritate the forehead of the user even if the peripheral edge of the hair ornament contacts the forehead.

The overlapping portion can easily be formed as follows:

First, a model having a flange disposed on an outer edge of a semispherical member and bent inwardly, and including a parting layer on an outer surface thereof is detachably mounted on the fixed base. The model may be integral with the fixed base. However, it is convenient for the model to be separate from the fixed base when the completed product is removed from the model after the overlapping portion is formed and fixed by the adhesive.

Then, the fiber strand which is to be provided with an overlapping portion is temporarily fastened partly to the model surface by pins. The fibers of the fiber strand extending from the fixed position to one end of the fibers are spread horizontally and bent, and the end fibers are caused to extend outwardly from the outer edge of the model. Thereafter, the end fibers extending outwardly from the outer edge of the model are tied along the flange of the model with a string. The end fibers are folded back over the outer surface of the model from the tied position and folded ends of the fibers superposed on adjacent fibers, thus forming an overlapped portion. The folded fibers are temporarily fastened to the model surface. Thereafter, an adhesive is sprayed or otherwise applied to bond the fibers in the overlapped portion, and then the string is removed from the overlapped portion. The overlapped portion thus formed is of a shape along the flange of the model, and the folded fiber ends in the overlapped portion are aligned along a straight line. The overlapped portion may simply be formed by shaping the end fibers of the formed portion to a curved configuration and fixing the fiber ends to adjacent fibers by an adhesive.

Figure 3:
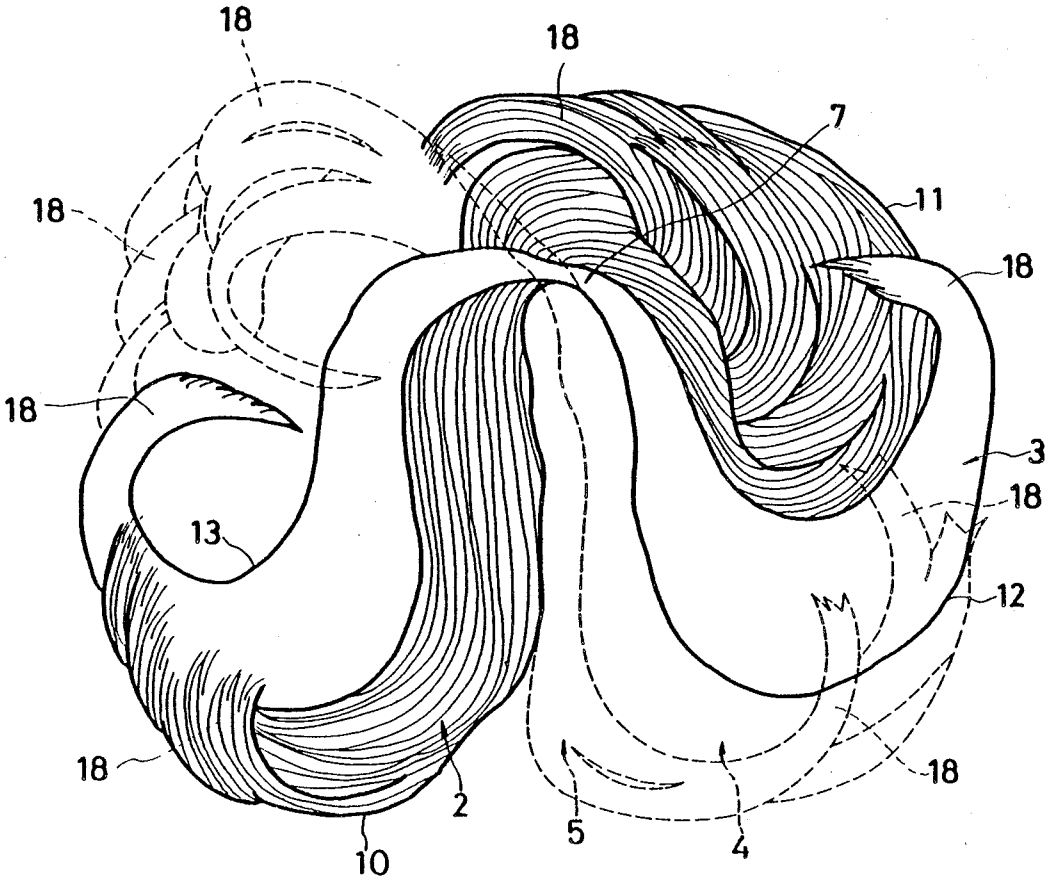
Figure 4:
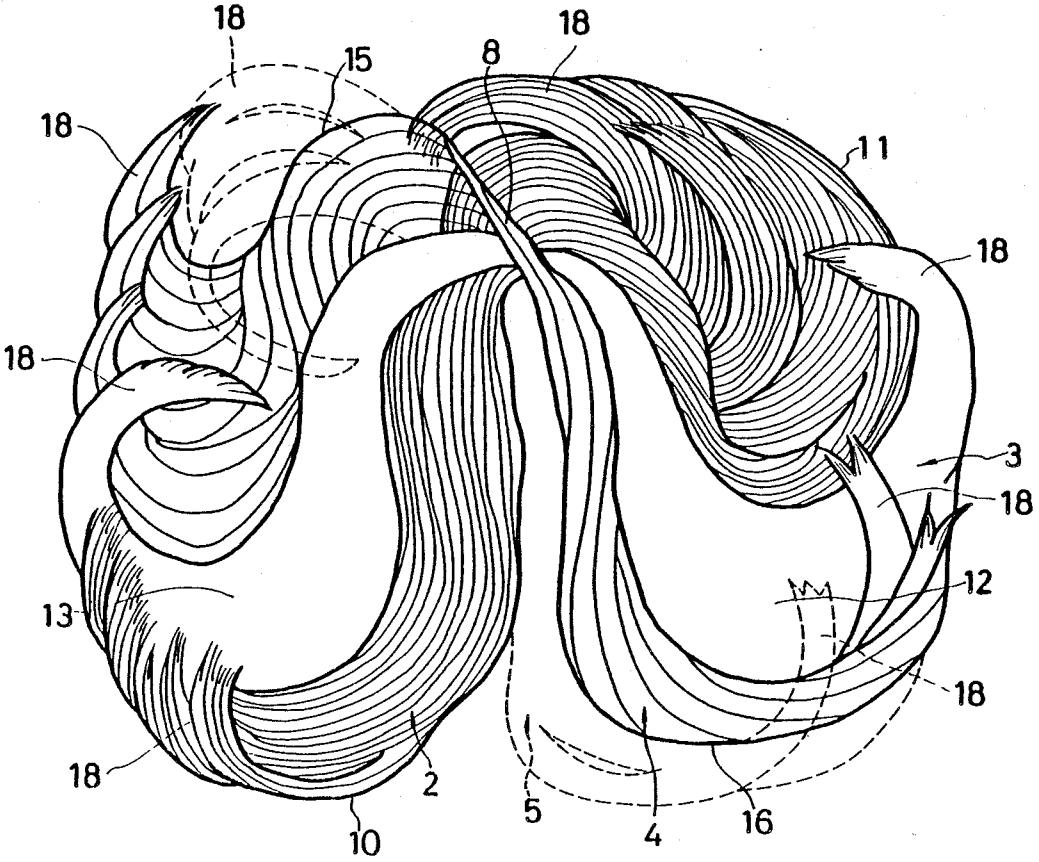
Figure 5:
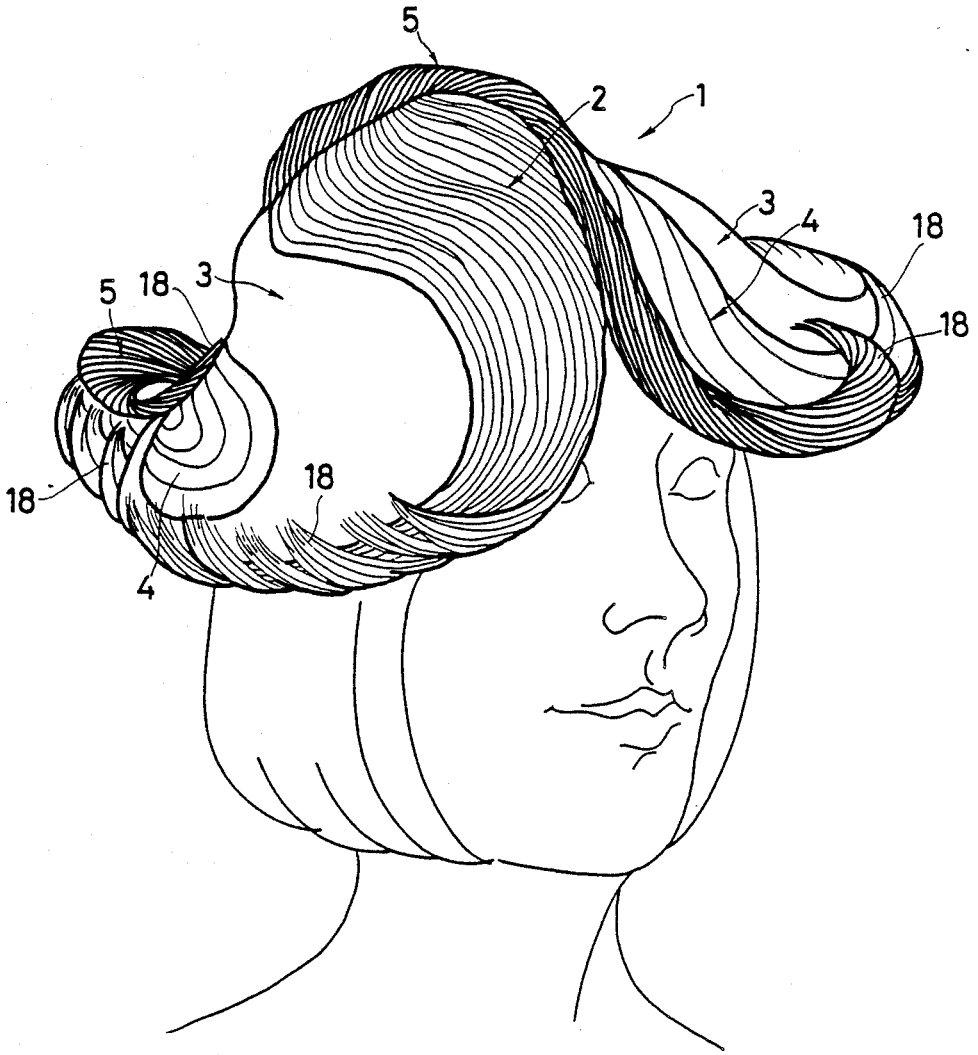
FIG. 5 is a perspective view of the hair ornament worn by a user.

FIGS. 1 through 6 show a hair ornament 1 according to an embodiment of the present invention, the hair ornament 1 being preferably used as a cap which may be worn by a user as shown in FIG. 5.

Figure 2:
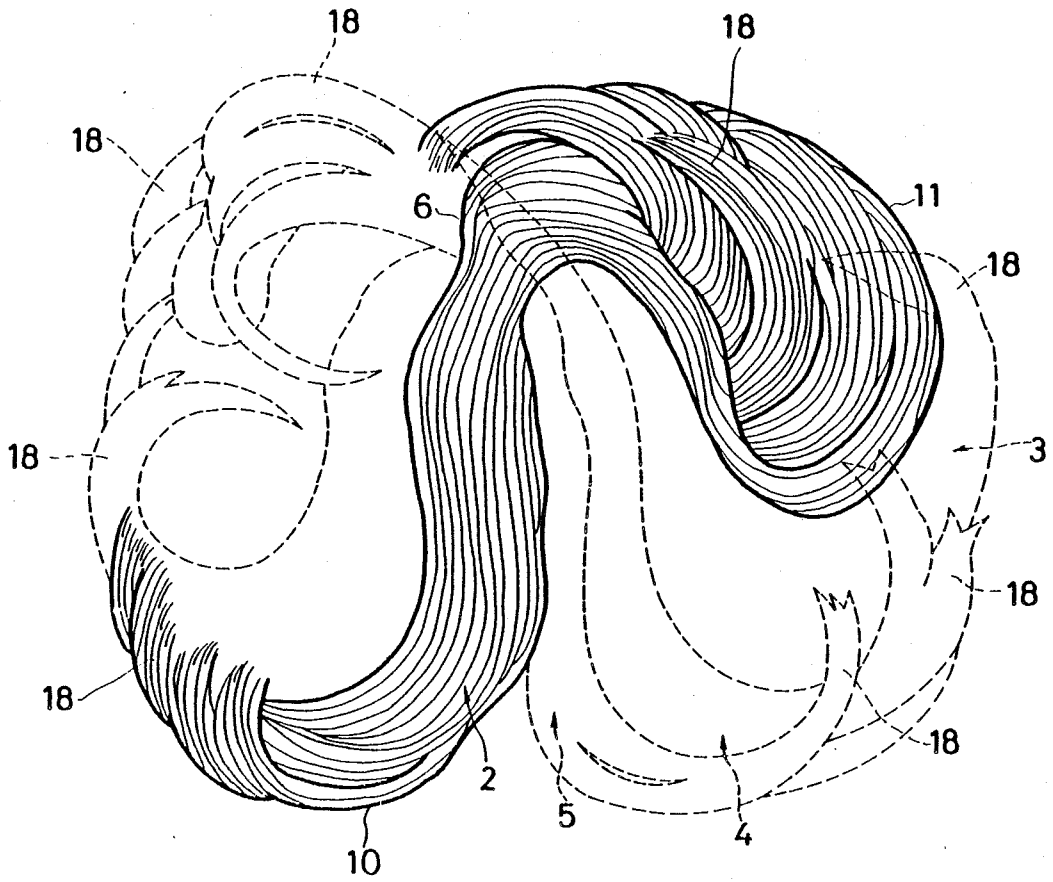
FIGS. 2 through 4 are exploded perspective views of strands of fibers of the hair ornament.

As shown in FIG. 1, the hair ornament 1 comprises four fiber strands 2, 3, 4, 5 of different colors, each composed of several thousands to ten thousands of fibers laid parallel to each other, the fibers being slightly curled and made of a copolymer of vinyl chloride and vinyl acetate and of about 70 denier. The hair ornament 1 is shown as completed in FIG. 1. FIG. 2 shows the fiber strand 2, the other fiber strands 3, 4, 5 being shown in the broken lines. FIG. 3 shows the fiber strand 2 and the fiber strand 3 placed thereon, the other fiber strands 4, 5 being shown in the broken lines. FIG. 4 illustrates the fiber strands 2, 3 and the fiber strand 4 placed thereon, the other fiber strand 5 being shown in the broken lines. (In each of FIGS. 1 through 5 and FIGS. 7 through 15, the fibers of the fiber strands are shown to the extent which is necessary to describe the invention.)

As illustrated in FIGS. 1 through 4, the fiber strands 2, 3, 4, 5 have respective gathered portions 6, 7, 8, 9 at their central positions where the fibers are closely gathered, and formed portions 10, 11; 12, 13; 14, 15; 16, 17, respectively, extending from the gathered portions 6, 7, 8, 9 horizontally toward the fiber ends in an partly overlapping fashion while being spread and bent. The fiber strands 2, 3, 4, 5 are successively superposed and crossed at the gathered portions 6, 7, 8, 9. The formed portions 10, 11; 12, 13; 14, 15; 16, 17 are spread flatwise while partly overlapping adjacent formed portions. The overall configuration of the hair ornament 1 is substantially bowl-shaped with its central portion raised and the peripheral skirt portion spread out. Each of the formed portions has an outer end 18 which includes curved fiber ends.

Mutually adjacent ones of the formed portions are bonded to each other by an adhesive, and mutually adjacent ones of the fibers of each of the formed portions are bonded to each other by an adhesive, thus providing an integral configuration.

Figure 6:
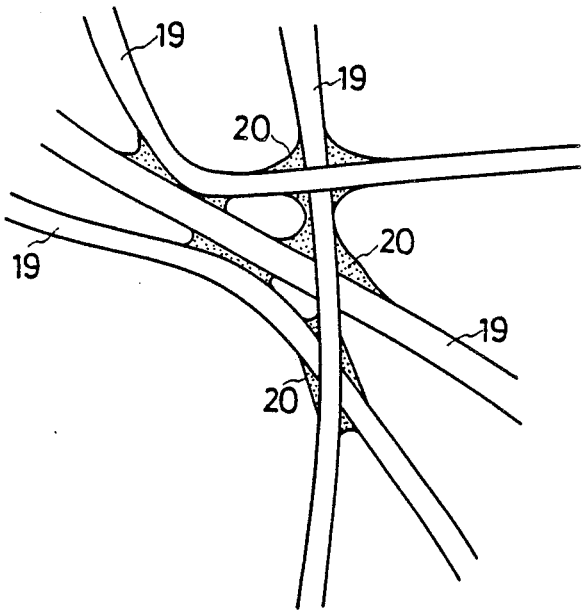
FIG. 6 is an enlarged fragmentary view of a portion of the hair ornament shown in FIG. 1.

More specifically, as shown in FIG. 6, fibers 19 are bonded to each other by an adhesive 20 in regions where they are superposed and crossed. The fibers 19 are curved by curls given thereto, and are subject to forces tending to space them apart under their resiliency, so that the fibers 19 are kept in equilibrium or a state of balance to maintain their formed shape.

FIGS. 7 through 10 show a hair ornament according to another embodiment of the present invention.

Figure 8:
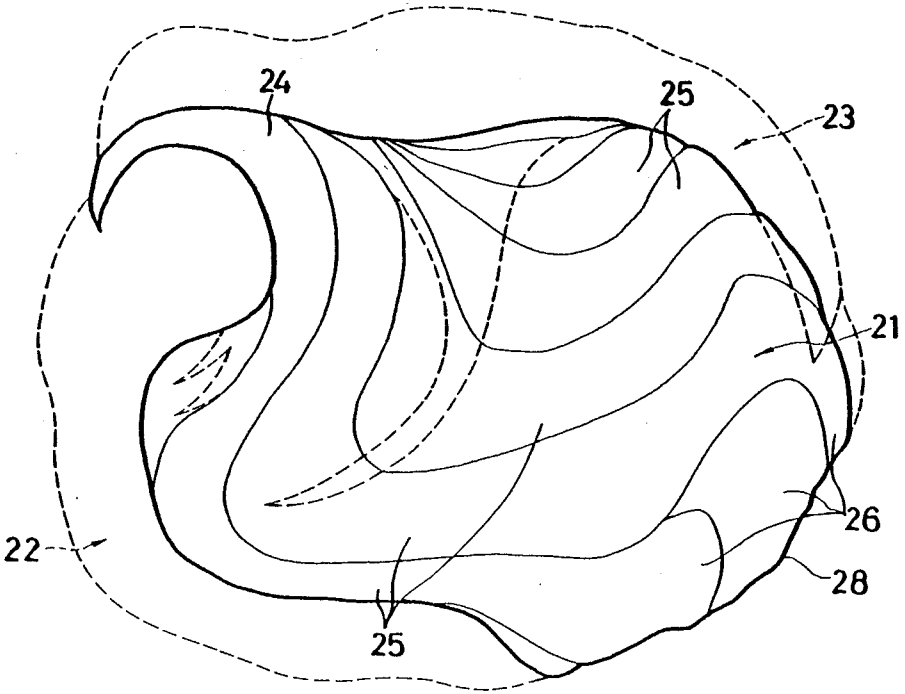
FIGS. 8 and 9 are exploded perspective views of strands of fibers of the hair ornament illustrated in FIG. 7.
Figure 9:
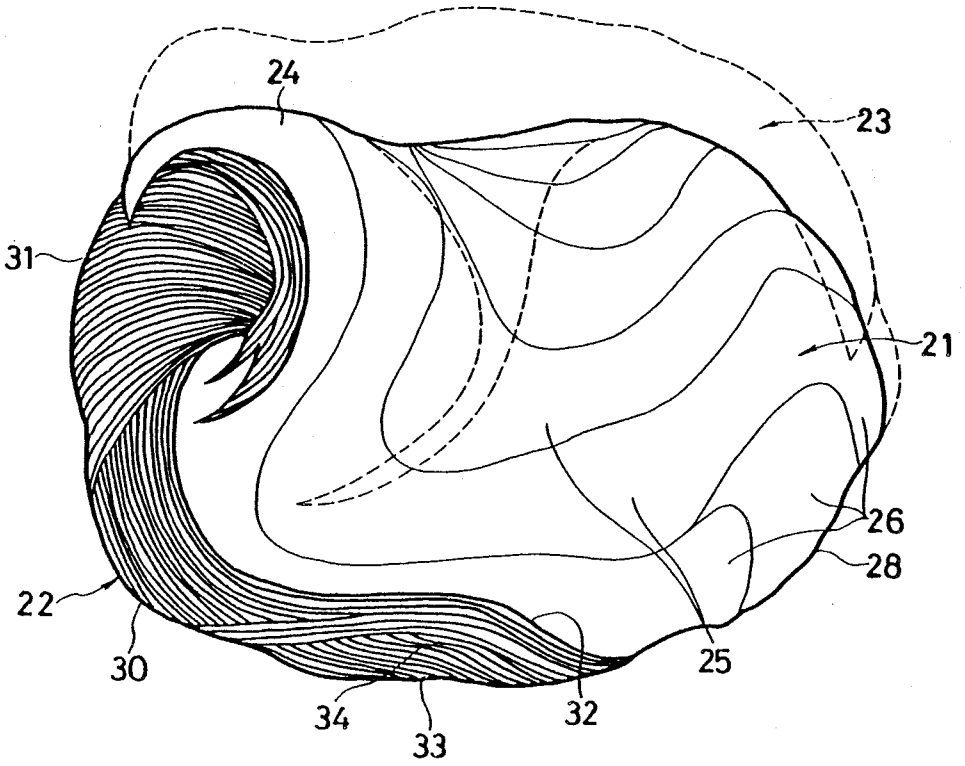

The hair ornament, generally designated by the reference numeral 1, comprises three fiber strands 21, 22, 23 of different colors, each composed of several thousands to ten thousands of fibers laid parallel to each other, the fibers being slightly curled acrylic fibers of about 50 denier. The hair ornament 1 is shown as completed in FIG. 7. FIG. 8 shows the fiber strand 21 only, the other fiber strands 22, 23 being shown in the broken lines. FIG. 9 shows the fiber strands 21, 22 laid parallel to each other and superposed where they are adjacent to each other, the other fiber strand 23 being shown in the broken lines.

Figure 10:
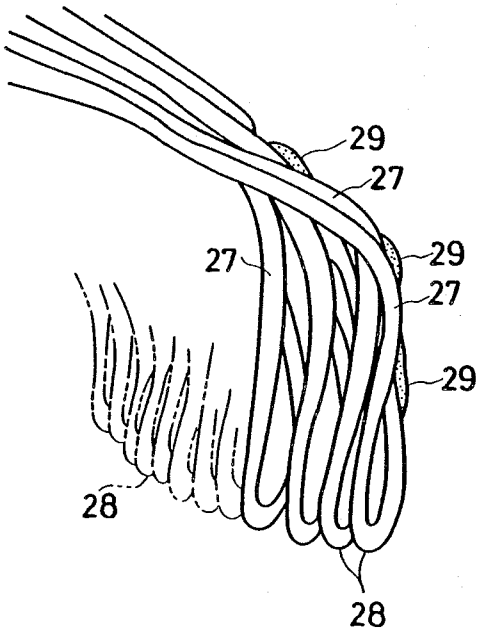
FIG. 10 is a cross-sectional view taken along line X—X of FIG. 7.

The fiber strand 21 has a gathered portion 24 at one end where the fibers are closely gathered, and a formed portion 25 spread horizontally from the gathered portion 24 toward the other end while the fibers are being overlapped, the formed portion 25 bent into a curved plane. The fiber strand 21 also has an overlapped portion 26 in which the fiber ends of the end of the formed portion 25 are folded back on themselves into overlapping relation to adjacent fibers. More specifically, as shown in FIG. 10, end fibers 27 are folded back at folded ends 28 in the longitudinal direction of the end fibers 27 into overlapping relation to the adjacent fibers 27, and fixedly bonded thereto by an adhesive 29, the folded ends 29 being aligned along a straight line.

As shown in FIG. 9, the fiber strand 22 runs from near the gathered portion 24 of the fiber strand 21 parallel to the formed portion 25, and is spread horizontally and bent while the fibers are being overlapped, providing a gathered portion 30 and formed portions 31, 32, which extend up to the overlapped portion 26 of the fiber strand 21. The formed portions 25, 31, 32 are bonded to each other in regions where they are overlapped. The fiber strands 22 also has an overlapped portion 34 having a folded end 33 similar to that of the overlapped portion 26, in the vicinity of the formed portion 25 of the fiber strand 21.

Figure 7:
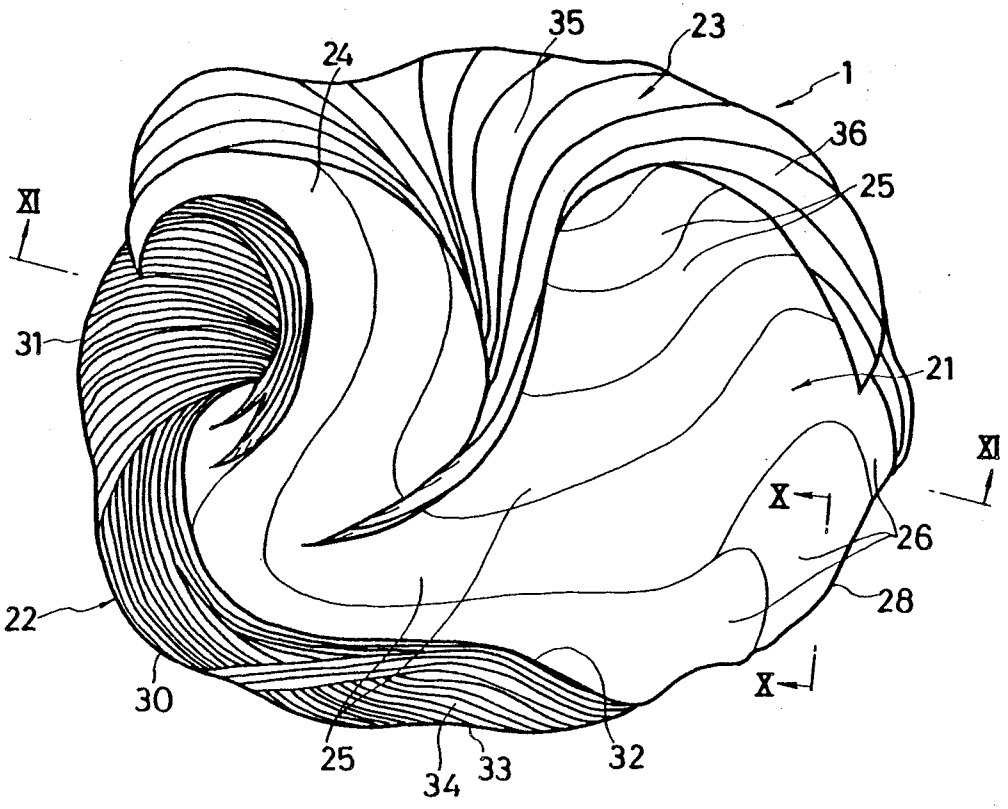
FIG. 7 is a perspective view of a hair ornament according to another embodiment of the present invention.

As shown in FIG. 7, the fiber strand 23 is disposed remotely from the fiber strand 22 with the fiber strand 21 disposed therebetween. The fiber strand 23 runs from near the gathered portion 24 of the fiber strand 21 along the formed portion 25, and is spread horizontally and bent while the fibers are being overlapped, providing formed portions 35, 36, which extend up to a position over the formed portion 25 of the fiber strand 21. The formed portion 25, 35, 36 are adhesively bonded to each other in regions where they are overlapped.

Figure 11:
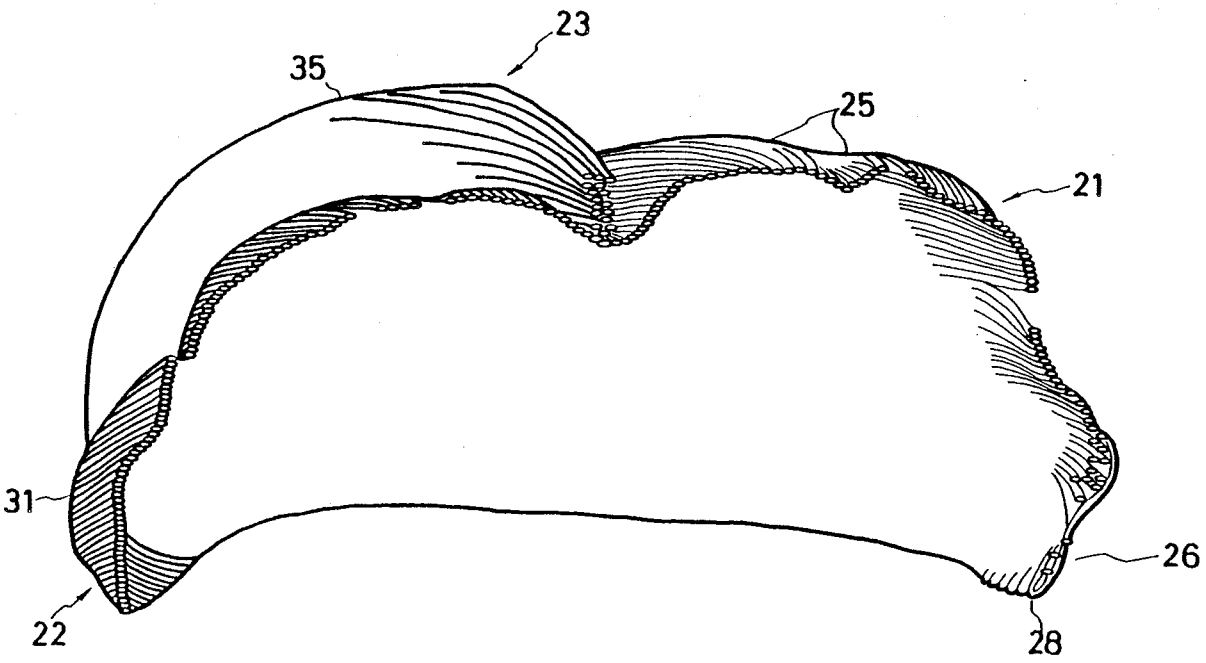
FIG. 11 is a cross-sectional view taken along line XI—XI of FIG. 7.

The hair ornament has an overall bowl-shaped configuration complementary to the head of a human being, as shown in FIG. 11. When the hair ornament is worn by a user in covering relation to the head of the user, the overlapped portion 26 serves as a peripheral edge portion held against the forehead of the user.

A method of manufacturing a hair ornament according to the present invention will be described with reference to FIGS. 12 through 15.

Figure 12:
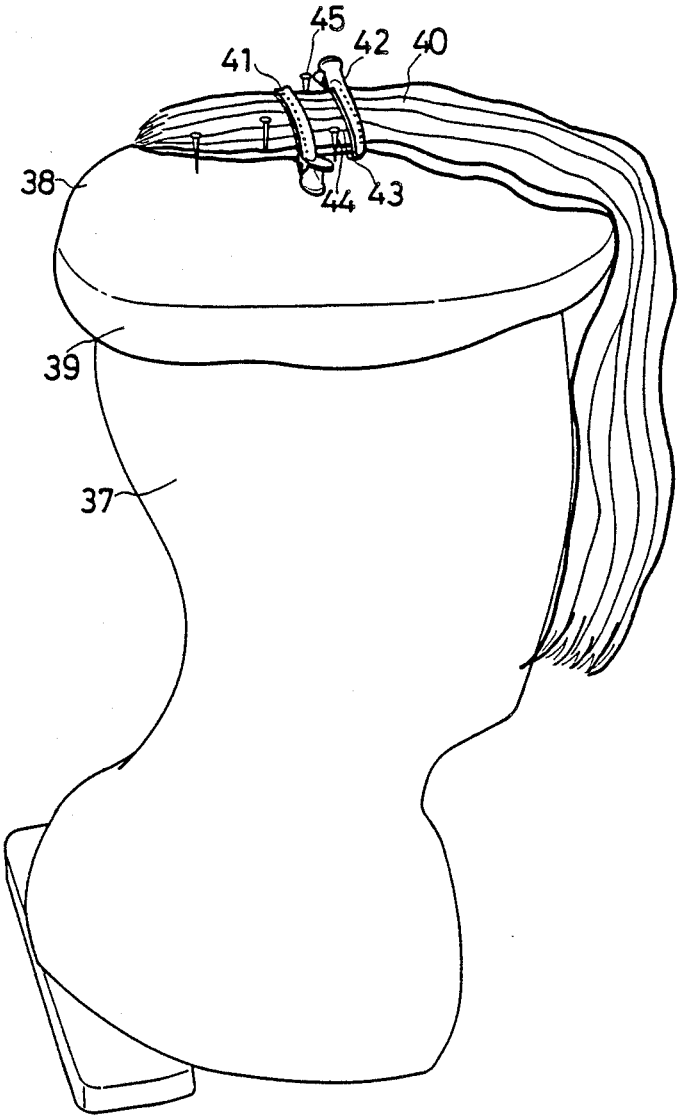
FIGS. 12 through 15 are views explaining a method of manufacturing a hair ornament according to the present invention.

First, as shown in FIG. 12, a detachable model 38 is placed on a fixed base 37 and detachably fixed thereto by means of pins or the like. The model 38 has an outer profile complementary to the inner surface of a completed hair ornament of the present invention. The model 38 has on its outer edge a flange 39 bent to extend inwardly and having an outer surface coated with a parting agent (not shown). A fiber strand 40 of gradually curled synthetic fibers laid parallel to each other is placed on the model 38. The fiber strand 40 is gripped near one end thereof by two clips 41, 42 to provide a gathered portion 43 where the fibers are gathered closely. The gathered portion 43 is temporarily fastened to the center of the surface of the model 38 on the fixed base 37 by pins 44, 45 passing through the gathered portion 43.

Figure 13:
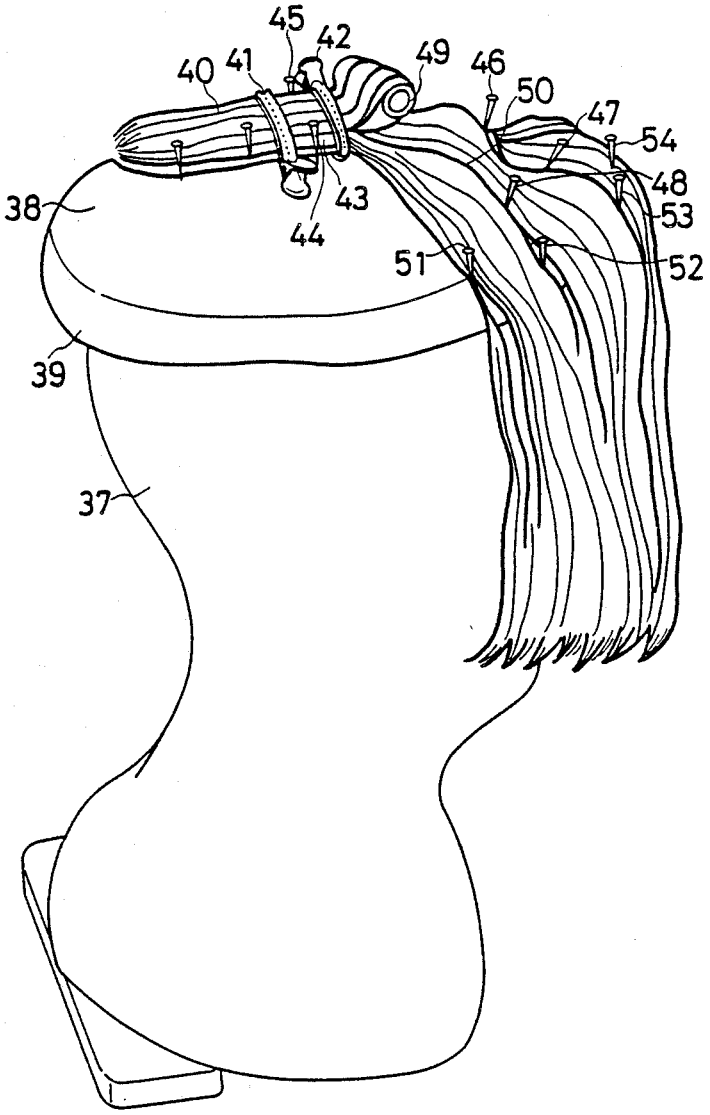

Then as shown in FIG. 13, the fibers are horizontally spread along the outer surface of the model 38 from the temporarily fastened gathered portion 43 of the fiber strand 40 toward the other end while the fibers are partly overlapped. Intermediate portions of the spread fibers are temporarily fastened by pins 46, 47, 48 to cause the fibers to run in a tortuous pattern. Some of the fibers are wound around a mesh curler 49 and heated by a drier or the like so as to be given a wave. The fibers are also shaped into a formed portion 50, and have ends having downwardly from the outer edge of the model 38 while the fiber ends are kept spread by means of pins 51, 52, 53, 54.

Figure 14:
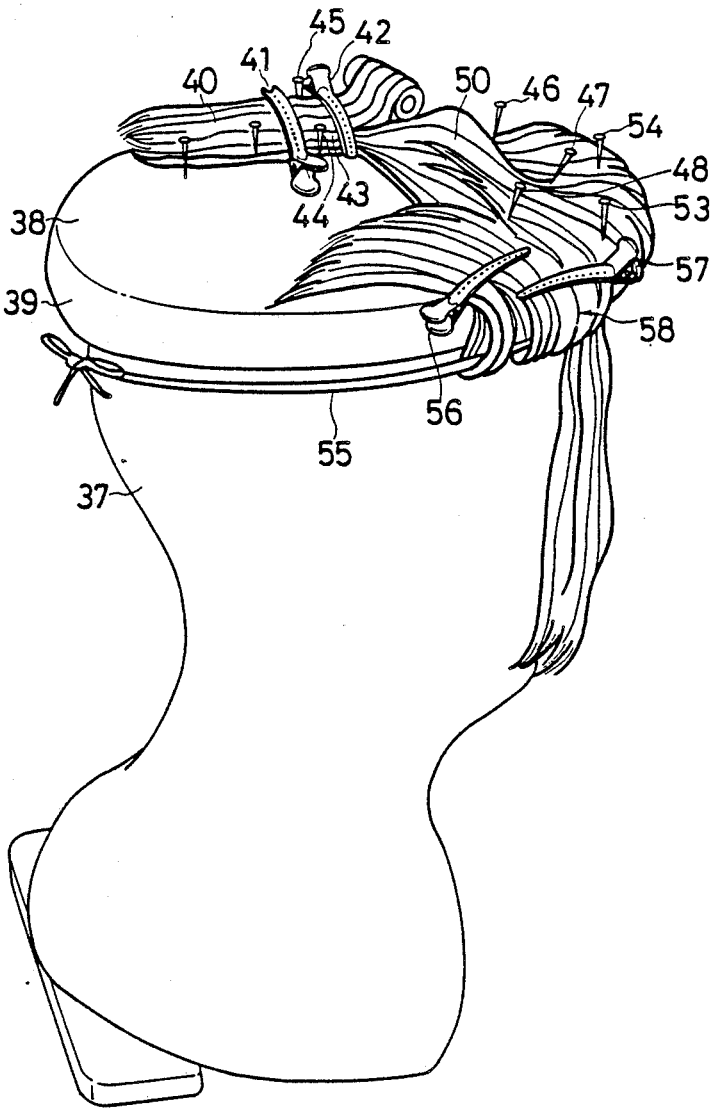

Thereafter, as illustrated in FIG. 14, the ends of the fibers hanging from the model 38 are put together and tied to the fixed base 37 along the flange 39 by means of a string 55. The fibers are then folded back on themselves from the tied position and directed toward the surface of the model 38. The adjacent fibers which are folded back are overlapped, and the fiber ends are fixed to the lower fibers on the model 38 by means of hair clips 56, 57, thus providing an overlapped portion 58. Thereafter, the folded fiber ends are temporarily fastened to the model 38 by means of pins, clips, or the like (not shown).

Figure 15:
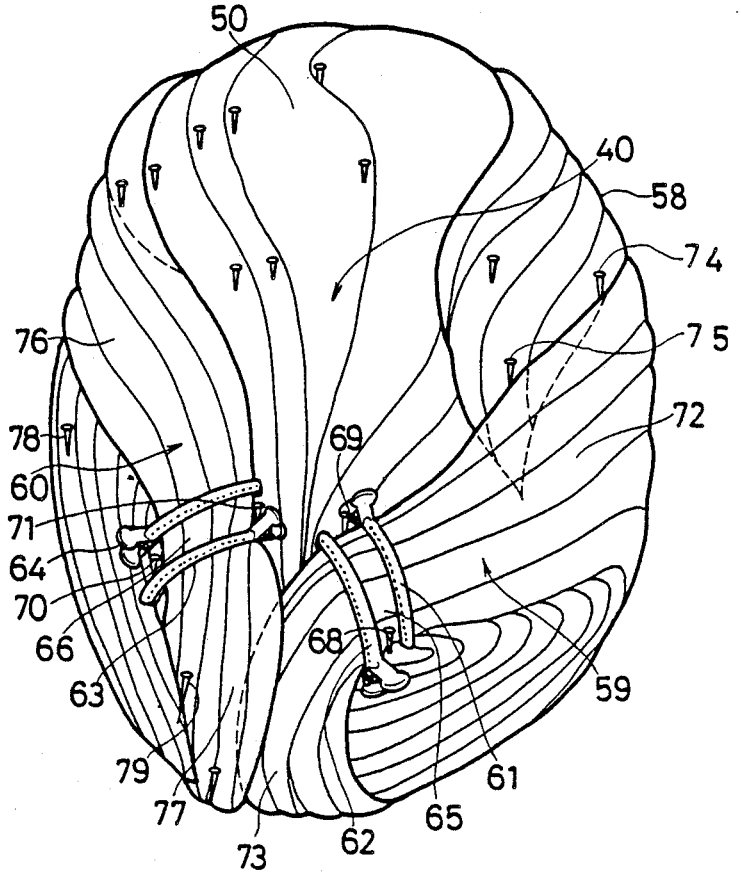

Then, as shown in FIG. 15, like the fiber strands 40, intermediate portions of other fiber strands 59, 60 are gripped by clips 61, 62; 63, 64 to provide gathered portions 65, 66 which are temporarily fastened to the model 38 by means of pins 68, 69; 70, 71 passing therethrough. The fibers of the fiber strand 59 disposed on the opposite sides of the gathered portion 65 and extending to the opposite ends of the fiber strand 59 are spread horizontally while they are partly overlapped. These fibers are then shaped into formed portions 72, 73 covering an uncovered surface of the model 38 in the same manner as the formed portion 50 is shaped. The formed portions 72, 73 are partly held in overlapping relation to the formed portion 50, and temporarily fastened to the surface of the model 38 by means of pins 74, 75. Formed portions 76, 77 of the fiber strand 60, which are shaped in the same manner as the formed portions 72, 73 of the fiber strand 59, and placed over another uncovered portion of the model 38, the formed portions 76, 77 being temporarily fastened by means of pins 78, 79.

An adhesive is then sprayed or otherwise applied over the entire assembly of the formed portions 50, 72, 73, 76, 77 to secure the formed portions 50, 72, 73, 76, 77 and the gathered portion 58 together and bond the fibers in each of the formed portions. The adhesive should be sprayed or otherwise applied several times to repeat adhesive drying and spraying cycles alternately so that the adhesive will not be attached to the fibers in droplets. If necessary, a forming agent is sprayed over the fibers to keep the shape of the hair ornament.

Then, the entire hair ornament as it is temporarily fastened to the model 38, is dried by a drier or by natural drying to dry the adhesive. Consequently, the string 55 and the pins are removed, the formed hair ornament detached, and an adhesive is sprayed over the inner surface thereof and dried. If necessary, a forming agent is sprayed over the inner surface of the hair ornament.

With the present invention, as describe above, a multiplicity of synthetic fibers are spread and bent into formed portions to provided a variety of formative appearances. The formed fibers are joined to each other by an adhesive only in regions where they are partly overlapped. Therefore, the hair ornament is flexible in its entirety, gives a soft formative look, is lightweight and permeable to air, does not give an odd look to other people even if it is worn at all times, and is of good formative appearance.

A formed portion of at least one fiber strand has an overlapped portion in which end fibers folded back in overlapping relation to adjacent fibers and bonded thereto. Therefore, when the hair ornament is put on the head of a user, a peripheral edge of the hair ornament which contacts the forehead of the user does not irritate the forehead. Accordingly, the hair ornament is very comfortable when worn.

Moreover, the hair ornament of the above structure can easily be manufactured according to the present invention.

Although certain preferred embodiments have been shown and described, it should be understood that many changes and modifications may be made therein without departing from the scope of the appended claims.

We claim:

1. A hair ornament having an inside for contact with a wearer's head and an outside and comprising a plurality of spaced strands each composed of a number of gradually curled synthetic fibers laid parallel to each other, each of said fiber strands having a formed portion in which fibers extending toward one end thereof are spaced horizontally and bent while being partly overlapped, said formed portions of said fiber strands being partly superimposed on formed portions of adjacent fibers and arranged to shape and hold said plurality of spaced fiber strands into a bowl-shaped configuration, said formed portions of said fiber strands including adjacent fibers fixed to each other solely by an adhesive applied over fibers of said fiber strands of the entire area of said hair ornament so as to maintain said hair ornament in said bowl-shaped configuration with said fibers and said strands exposed on the inside and outside of said hair ornament, said inside fibers and strands being exposed on the inside of said hair ornament for contact with the wearer's head.

2. A hair ornament according to claim 1, wherein said fiber strands are laid parallel to each other.

3. A hair ornament according to claim 1, wherein each of said fiber strands having a first formed portion in which fibers extending toward one end thereof are spread horizontally and bent while being partly overlapped, and a second formed portion in which fibers extending toward the opposite end thereof are spread horizontally and bent while being partly overlapped.

4. A hair ornament according to claim 2, wherein said fiber strands are crossed and superposed at their intermediate positions.

5. A hair ornament according to claim 1, wherein the fibers of each of said fiber strands comprise fibers of at least two colors.

6. A hair ornament according to claim 1, wherein said fiber strands comprise fibers of different colors.

7. A hair ornament having an inside for contact with a wearer's head and an outside and comprising a plurality of spaced fiber strands each composed of a number or gradually curled synthetic fibers laid parallel to each other, at least one of said fiber strands having a formed portion in which fibers extending toward one end thereof are spread horizontally and bent while being partly overlapped, and an overlapping portion in which end fibers of said formed portion are folded back in overlapping relation to adjacent fibers, the other fiber strands having respective formed portions in which fibers extending toward one end thereof are spread horizontally and bent while being partly overlapped, said formed portions of said fiber strands being partly superposed on formed portions of adjacent fibers and arranged to shape and hold said plurality of spaced fiber strands into a bowl-shaped configuration, said formed portions of said fiber strands including adjacent fibers fixed to each other solely by an adhesive applied over fibers of said fiber strands of the entire area of said hair ornament so as to maintain said hair ornament in said bowl-shaped configuration with said fibers and said strands exposed on the inside and outside of said hair ornament, said inside fibers and strands being exposed on the inside of said hair ornament for contact with the wearer's head.

8. A hair ornament according to claim 7, wherein said overlapped portion includes a folded end serving as a peripheral edge of the formed portion.

* * * * *